US006665898B2

(12) United States Patent
Gordon

(10) Patent No.: US 6,665,898 B2
(45) Date of Patent: Dec. 23, 2003

(54) DEVICE FOR CORRECTING A SAGGING BED

(76) Inventor: Bruce Gordon, 26661 Ave. Arivara, Mission Viejo, CA (US) 92691

( * ) Notice: Subject to any disclaimer, the term of this patent is extended or adjusted under 35 U.S.C. 154(b) by 0 days.

(21) Appl. No.: 10/006,857

(22) Filed: Dec. 3, 2001

(65) Prior Publication Data

US 2003/0101515 A1 Jun. 5, 2003

(51) Int. Cl.[7] ..... A47C 21/06
(52) U.S. Cl. ..... 5/659; 5/658
(58) Field of Search ..... 5/659, 658, 644, 5/654, 655.3, 706, 710, 711, 712, 713, 715

(56) References Cited

U.S. PATENT DOCUMENTS

| | | | | | |
|---|---|---|---|---|---|
| 2,582,439 | A | * | 1/1952 | Kavanagh | 297/396 |
| 2,728,926 | A | * | 1/1956 | Emery | 5/644 |
| 2,731,652 | A | * | 1/1956 | Bishop | 5/710 |
| 2,896,227 | A | * | 7/1959 | Reed | 5/644 |
| 3,017,221 | A | * | 1/1962 | Emery | 5/644 X |
| 3,235,892 | A | * | 2/1966 | Emery | 441/130 |
| 3,253,861 | A | * | 5/1966 | Howard | 297/452.43 |
| 3,276,047 | A | * | 10/1966 | Emery | 5/654 |
| 3,308,489 | A | * | 3/1967 | Winkler | 5/644 X |
| 3,416,169 | A | * | 12/1968 | Emery | 5/644 |
| 3,644,949 | A | * | 2/1972 | Diamond | 5/630 |
| 3,717,885 | A | * | 2/1973 | De Mare | 5/607 |
| 3,736,027 | A | * | 5/1973 | Stafford | 297/452.43 |
| 3,775,781 | A | * | 12/1973 | Bruno et al. | 5/607 |
| 3,795,021 | A | * | 3/1974 | Moniot | 5/644 |
| 4,136,412 | A | * | 1/1979 | Wilhelm | 5/417 |
| 4,161,794 | A | * | 7/1979 | Darnfors | 5/644 |
| 4,459,714 | A | * | 7/1984 | Lin | 5/655.3 |
| 4,551,874 | A | * | 11/1985 | Matsumura et al. | 5/630 |
| 4,639,960 | A | * | 2/1987 | Quillen et al. | 5/710 |
| 4,685,163 | A | * | 8/1987 | Quillen et al. | 5/710 |
| 4,697,290 | A | * | 10/1987 | Alklind et al. | 5/632 |
| 4,724,558 | A | * | 2/1988 | Reiff | 5/417 |
| 4,745,645 | A | * | 5/1988 | McWilliams | 5/659 |
| 4,807,313 | A | * | 2/1989 | Ryder et al. | 5/713 X |
| 4,934,002 | A | * | 6/1990 | Watanabe | 5/607 |
| 4,962,553 | A | * | 10/1990 | Marquis | 5/710 |
| 4,965,897 | A | * | 10/1990 | Taylor | 5/659 |
| 5,020,168 | A | * | 6/1991 | Wood | 5/710 X |
| 5,070,559 | A | * | 12/1991 | Pettifer | 5/659 |
| 5,142,720 | A | * | 9/1992 | Kelso et al. | 5/630 |
| 5,257,430 | A | * | 11/1993 | Yamaguchi | 5/659 |
| 5,313,679 | A | * | 5/1994 | Yamaguchi | 5/659 |
| 5,412,822 | A | * | 5/1995 | Kelly | 5/655.3 |
| 5,809,597 | A | * | 9/1998 | Shaw | 5/655.3 |
| 5,898,963 | A | * | 5/1999 | Larson | 5/644 |
| 5,926,883 | A | * | 7/1999 | Rechin et al. | 5/706 |
| 5,988,747 | A | * | 11/1999 | Jeans | 5/655.3 X |
| 6,131,219 | A | * | 10/2000 | Roberts | 5/644 |
| 6,145,142 | A | * | 11/2000 | Rechin et al. | 5/706 |
| 6,327,724 | B1 | * | 12/2001 | Sharrock et al. | 5/654 X |
| 6,370,716 | B1 | * | 4/2002 | Wilkinson | 5/715 |
| 2003/0101515 | A1 | * | 6/2003 | Gordon | 5/659 |

FOREIGN PATENT DOCUMENTS

| | | | | | |
|---|---|---|---|---|---|
| GB | 2194883 | A | * | 3/1988 | 5/644 |

* cited by examiner

*Primary Examiner*—Robert G. Santos
(74) *Attorney, Agent, or Firm*—Steins & Associates, P.C.

(57) ABSTRACT

A Device for Correcting a Sagging Bed is disclosed. The device may be configured to be placed under the center region of a sagging or new mattress, after which the device is inflated to correct the sagging portion, or to provide additional support. The device may further be divided up into two or more chambers in order to prove additional control and adjustment. The device further may include between two and four lobes extending outwardly at ninety degrees from one another.

16 Claims, 8 Drawing Sheets

DEVICE FOR CORRECTING A SAGGING BED

BACKGROUND OF THE INVENTION

1. Field of the Invention

This invention relates generally to beds, mattresses and box springs and, more specifically, to a Device for Correcting a Sagging Bed 2. Description of Related Art It is known that many people suffer from a variety of ailments of the back and shoulders, frequently requiring the services of a trained professional, such as a chiropracter, to obtain relief. Many times these back problems are actually caused by poor support and/or posture while sleeping. In view of the fact that the average person will spend 6 to 8 hours per day, every day, sleeping and/or laying in bed, it is no surprise that a faulty bed could cause distress. While purchasing a new mattress may be the quickest way to alleviate the problem, it seems that many people either refuse to part with their old mattress, or they don't budget the money for a mattress when a replacement is called for, or they simply don't seem to notice that the bed has begun to deteriorate. What is needed is a quick, inexpensive, and easy accessory that will correct the sag in an old mattress. Furthermore, a new mattress will begin to deteriorate from the first time that it is slept on, just as a new automobile will deteriorate the moment it is driven off of the car lot. Unlike an automobile, however, a mattress does not get serviced periodically. If the present invention is used from the start on a new mattress, it is believed that the aforementioned deterioration will be avoided, thereby increasing the longevity of the mattress by providing extra support.

SUMMARY OF THE INVENTION

In light of the aforementioned problems associated with the prior devices, it is an object of the present invention to provide a Device for Correcting a Sagging Bed. The device should be configured to be placed under the center region of a sagging or new mattress, after which the device is inflated to correct the sagging portion, or to provide additional support. The device may further be divided up into two or more chambers in order to prove additional control and adjustment. The device might further include between two and four lobes extending outwardly at ninety degrees from one another.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a Device for Correcting a Sagging Bed.

Figure 1:
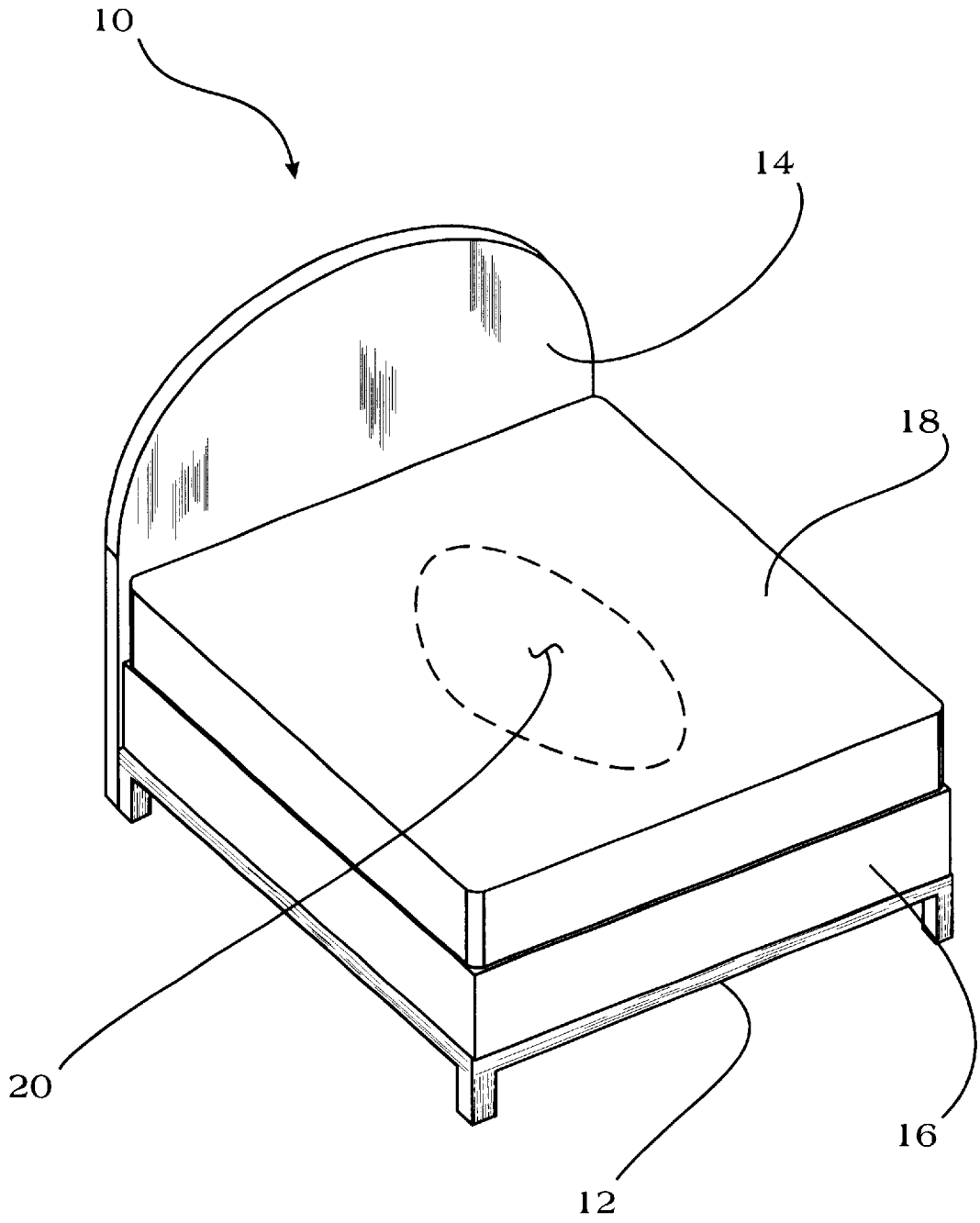
FIGURE 1 PRIOR ART
FIG. 1 is a perspective view of a conventional bed.

The present invention can best be understood by initial consideration of FIG. 1. FIG. 1 is a perspective view of a conventional bed 10, provided simply so that reference can be made to it later in this document. As shown, the convention bed 10 typically comprises a bed frame 12 for supporting the structure, as well as some sort of head board 14 for decorative or functional purposes. Resting on the bed frame 12 is a box spring 16, which essentially consists of a wood or metal frame, a matrix of springs and padding, and a sheath of cloth. The purpose of the box spring 16 is to permit the mattress 18 to conform to the person's body while also providing a cushioned support. The mattress 18 may be constructed in a variety of ways, ranging from a basic stuffing to a sophisticated spring system. In any design, there can be a tendency for the mattress 18 and/or box spring 16 to become permanently compressed from continuous use. When the mattress 18 and/or box spring 16 fails to return to its original shape, it results in a "sagging" portion in the sleeping surface. In particular, the center region 20 of the mattress will tend to sag first, since it is where the greatest portion of the sleepers' weight is located. As such, the present invention seeks to correct this mattress sag in the center region 20 of the sleeping surface. Prior to discussing the specifies of the present invention, we shall first review the sagging of the bed as discussed in FIGS. 2A and 2B.

Figure 2A:
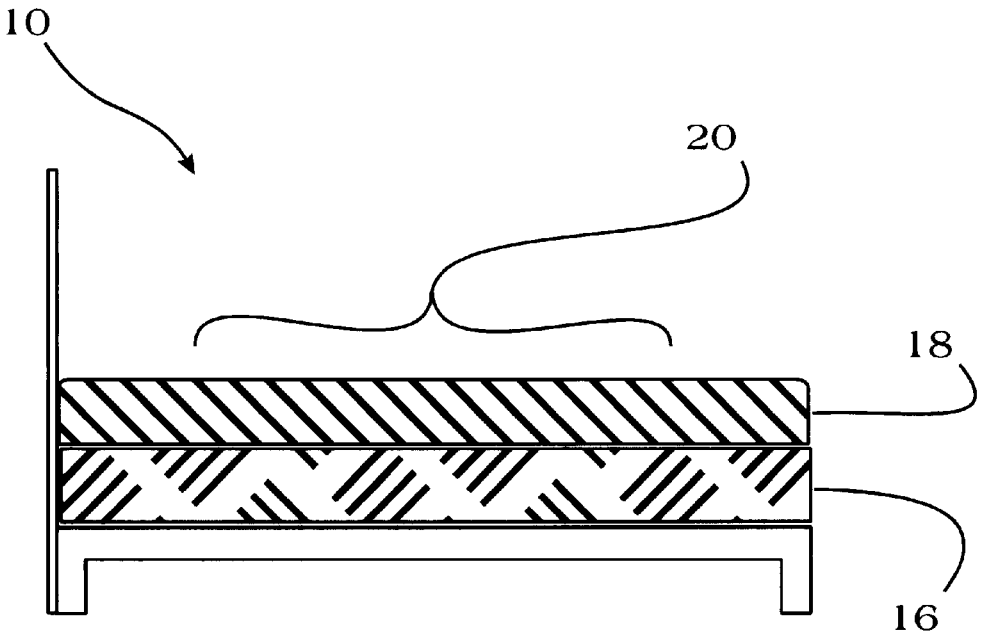
FIGURE 2A PRIOR ART
FIGS. 2A and 2B are cutaway side views of a conventional bed.
Figure 2B:
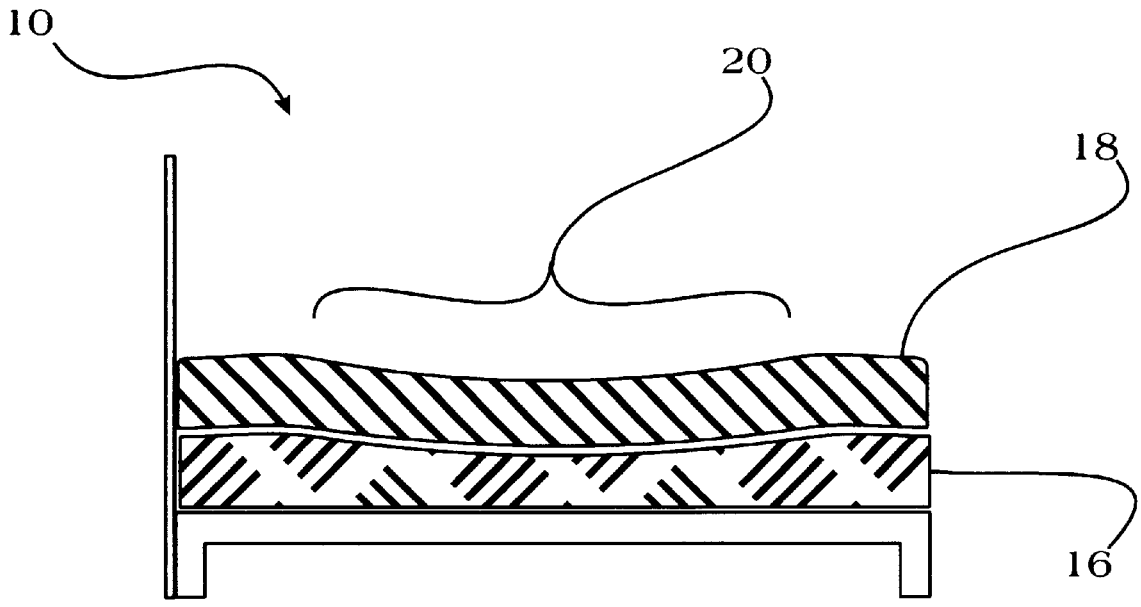
FIGURE 2B PRIOR ART

FIGS. 2A and 2B are cutaway side views of a conventional bed 10, such as the one discussed above, in connection with FIG. 1. As shown in FIG. 2A, the center region 20 of the bed 10 is central between the head and foot of the bed 10, as well as from side to side (see FIG. 1). If we look at FIG. 2B, we can see that as the bed 10 becomes more and more worn, the center region 20 of mattress 18, and possibly even the box spring 16 will begin to sag downwardly, thereby creating a dip in the mattress 18, which can lead the user to experience discomfort. If we now turn to FIGS. 3A and 3B, we can see how the present invention cures this problem.

Figure 3A:
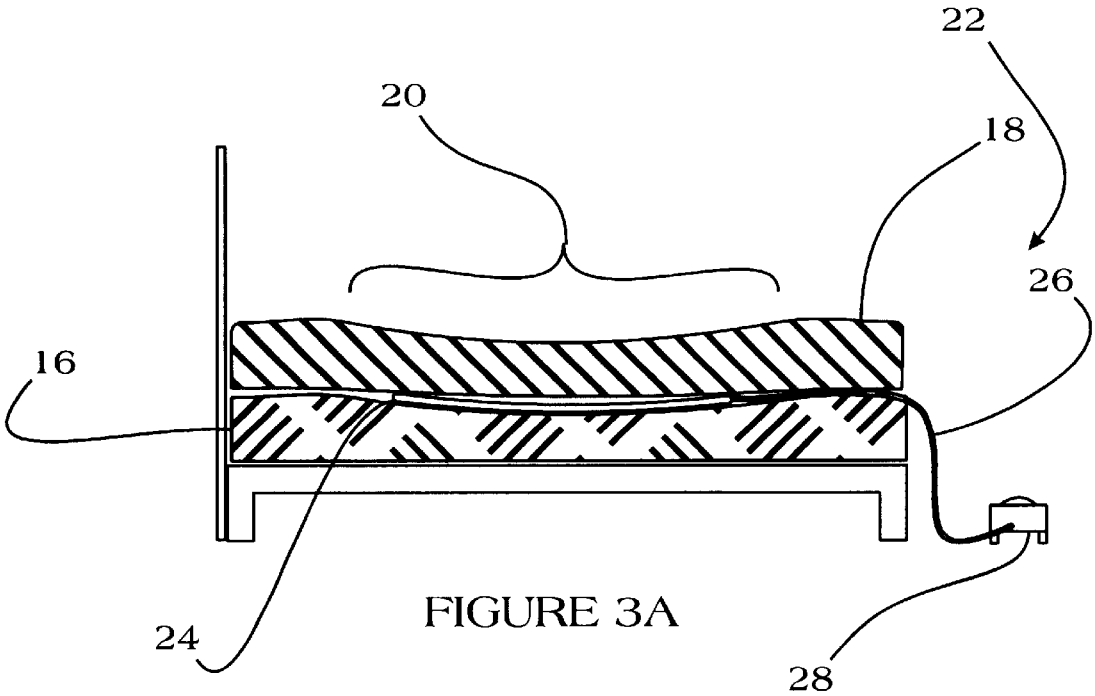
FIGS. 3A and 3B are cutaway side views of the bed of FIGS. 2A and 2B, further depicting the operation of the present invention.
Figure 3B:
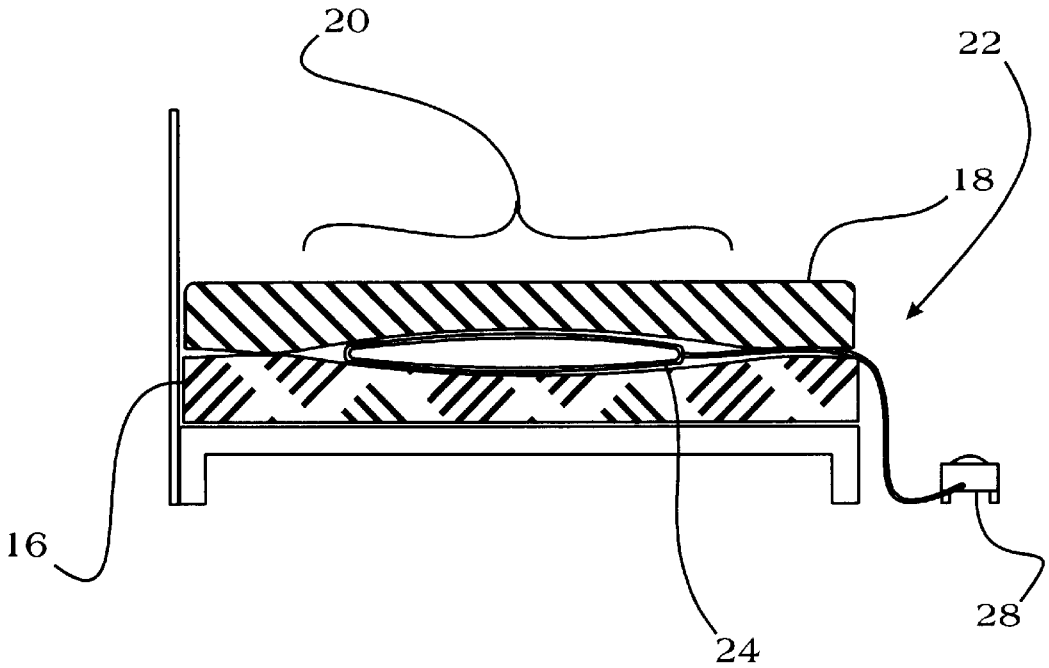

FIGS. 3A and 3B are cutaway side views of the bed 10 of FIGS. 2A and 2B, further depicting the operation of the present invention. The invention, hereafter referred to as the bed corrector 22, comprises a bladder 24 and a means for inflating the bladder 24. In this embodiment, the inflation means comprises an inflation hose 26, which leads to an air pump 28. In other versions, the bladder might simply have valves disbursed on its surface for filling the bladder 24 with air (and also deflating the bladder 24).

As shown in FIG. 3A, the bladder 24 is first inserted into the center region 20, between the mattress 18 and box spring 16. Next, and as shown in FIG. 3B, the bladder 24 is inflated until the dip or sagging portion in the center region 20 of the mattress 16 essentially disappears. It can be seen that the sag in the box spring 16 has also been cured by the bed corrector 22. While we have discussed only the conventional mattress-and-box spring type bed, it should be understood that the bed corrector 22 will function superbly with other configurations, to include futons, hard topped or solid base beds, as well as other bed designs. If we now turn to FIG. 4, we can begin to examine the novel designs of the bladder 24.

Figure 4:
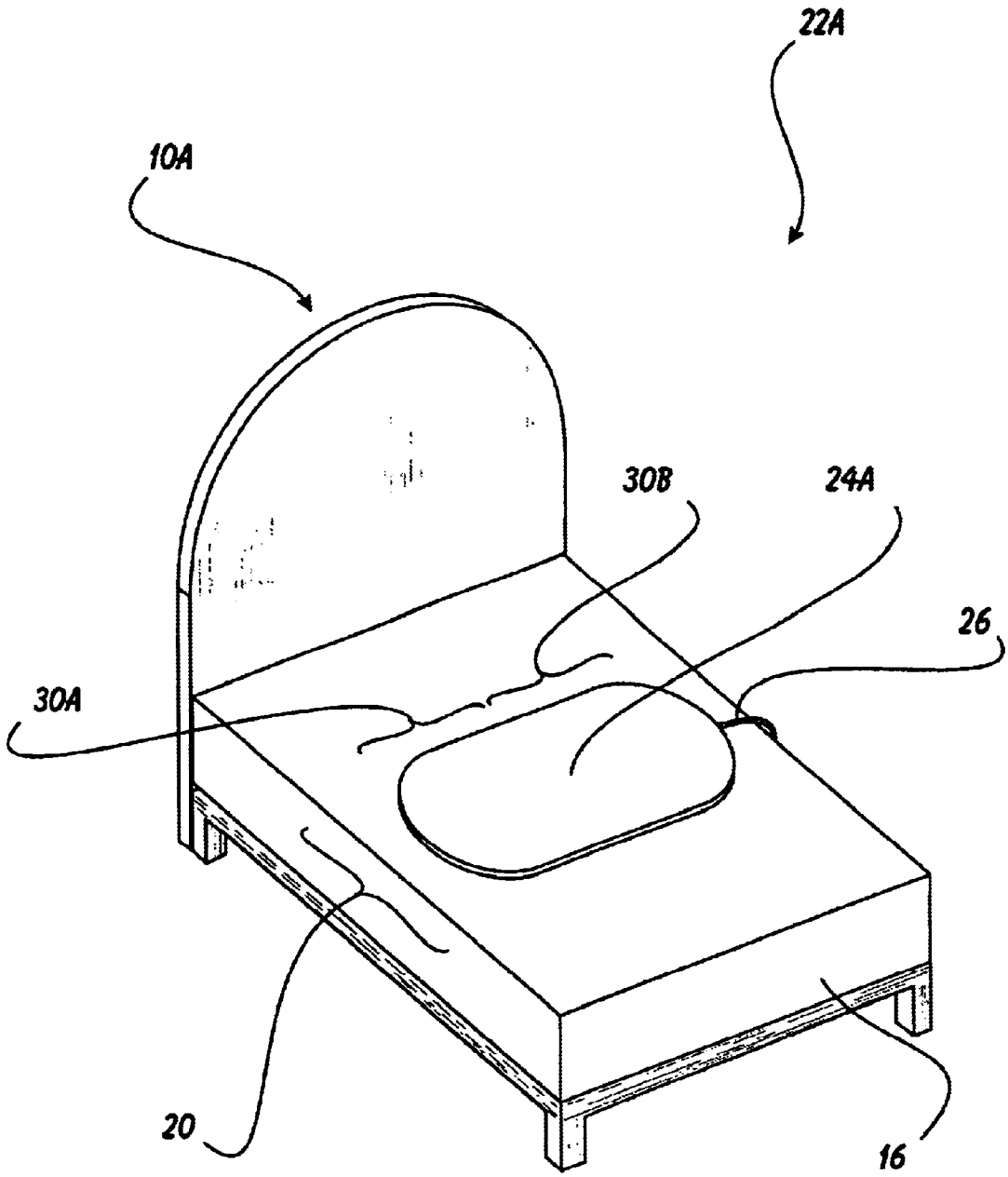
FIG. 4 is a perspective view of a conventional twin bed box spring and a dual lobe embodiment of the present invention.

FIG. 4 is a perspective view of a conventional twin bed box spring 16 and a dual lobe embodiment 24A of the present invention 22A. As shown here, the bladder 24A in this example, for use on a narrower bed, has a pair of opposing lobes 30A and 30B. Prior to inflation, the bladder 24A is first placed in the center region 20 of the box spring (or course, the mattress (not shown) will then be placed atop the bladder 24A. As will be discussed further below, the lobes 30 may be independently inflatable (i.e. one may be inflated to a different pressure than the other) to correct side-to-side variation in the sag of the mattress (not shown). In such a design, the inflation hose 26 would be connected to both lobes 30 (or at least connectable) for independent inflation of each. The example of the corrector 22 for a larger-sized bed is first shown in FIG. 5.

Figure 5:
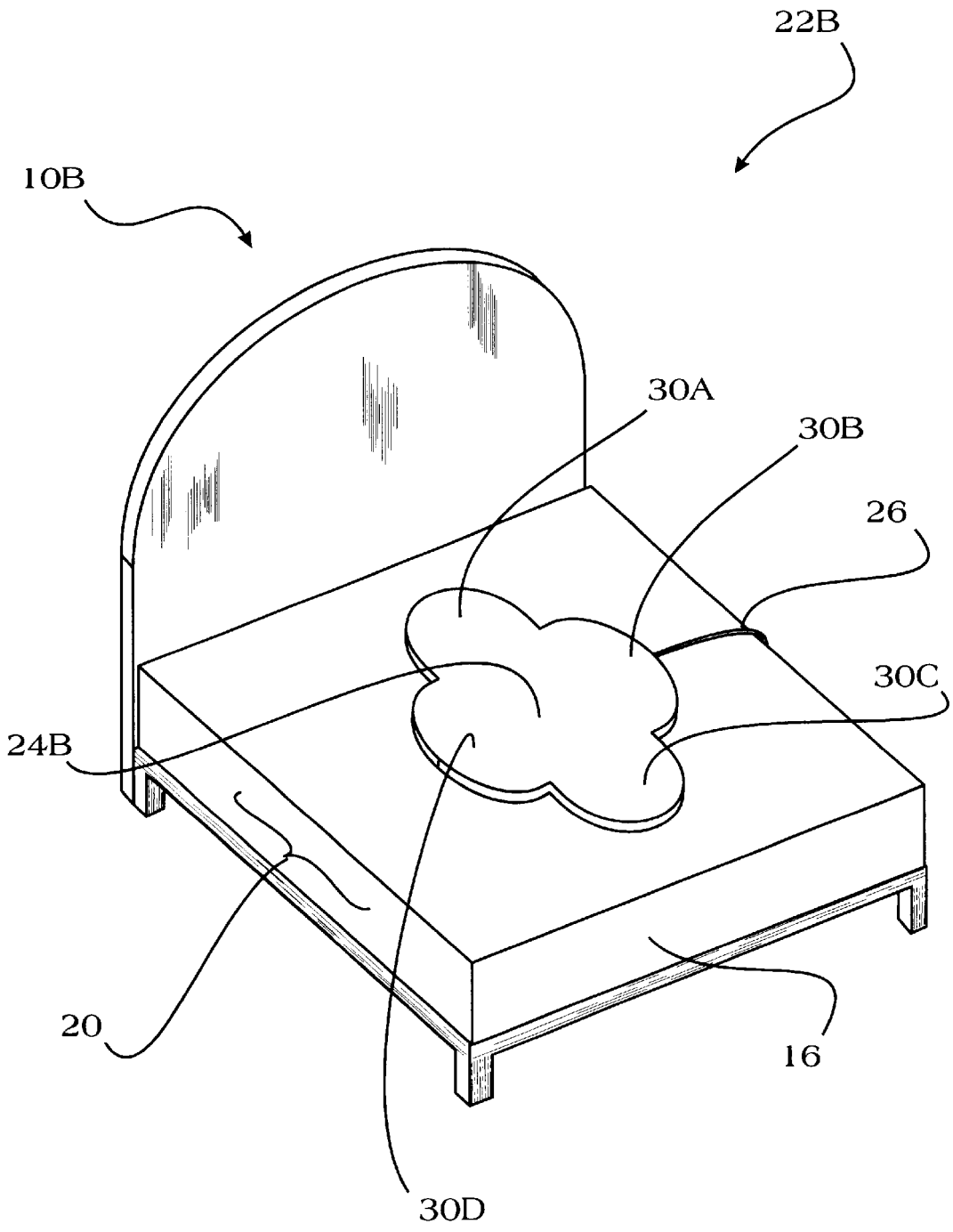
FIG. 5 is a perspective view of a conventional large bed box spring and a four lobe embodiment of the present invention.

FIG. 5 is a perspective view of a conventional large bed box spring 16 and a four lobe embodiment 24B of the present invention 22B. As shown, the four lobe bed corrector embodiment 22B includes a four lobe bladder 24B. While this design might be used on smaller beds, it is of particular usefulness on a double, queen or king bed, since the center regions 20 of these larger beds is typically caused to sag by more than one person. We can see that in its preferred form, the four lobe bladder 24B has a first lobe 30A, a second lobe 30B at a ninety degree angle from the first lobe 30A, a third lobe 30C at a ninety degree angle from the second lobe 30B (and opposite the first lobe 30A), and a fourth lobe 30D at a ninety degree angle from the third lobe 30C and first lobe 30A. As is discussed more fully below, the bladder 24B is compartmented to provide great flexibility and utility in the inflation and support options, such that the bed corrector 22B can compensate for a wide range of variety of sagging center regions 20.

Figure 6:
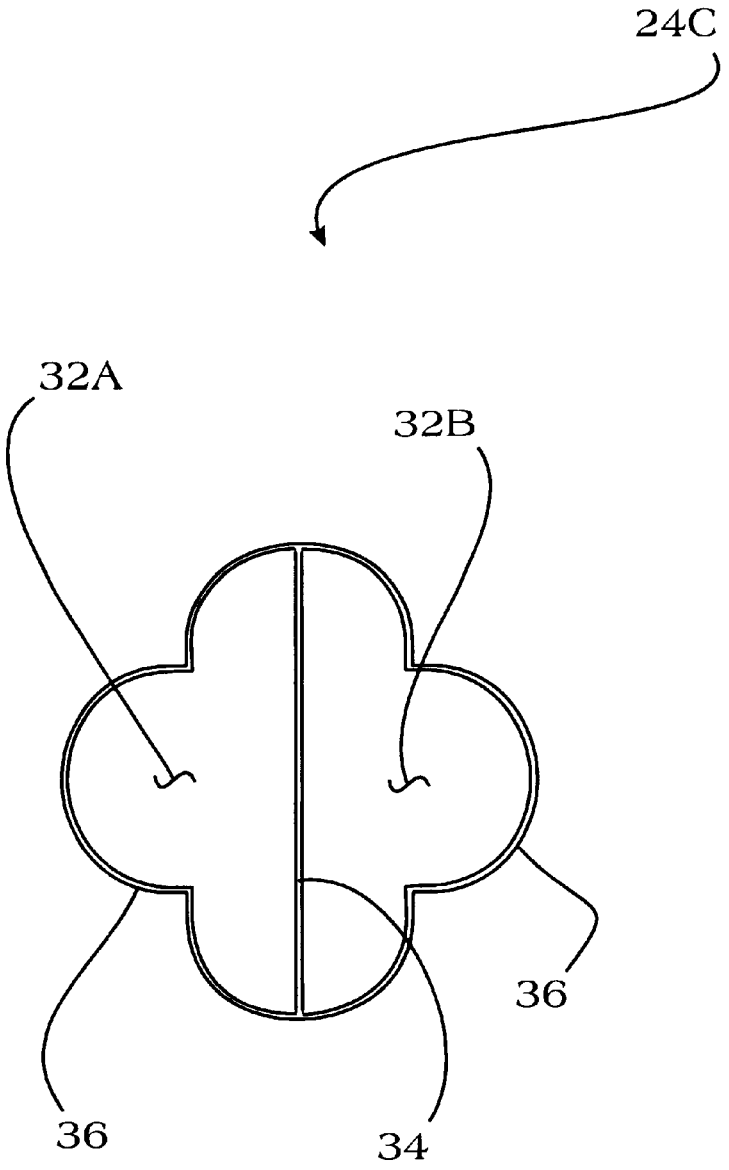
FIG. 6 is a cutaway top view of a dual chamber bladder embodiment of the present invention.

FIG. 6 is a cutaway top view of a dual chamber bladder embodiment 24C of the present invention. This bladder 24C is divided into two equal chambers 32A and 32B by a chamber wall 34, which bisects the first and third lobes (see FIG. 5). We can also see that the edges 36 of the two air tight sheets of material forming the bladder 24C are bonded to one another to form the two chambers 32. As discussed above, the air pressure within the chambers 32 will be individually adjustable in order to provide tailored sag-compensation for each side of the center region (see FIG. 5) of the mattress. Now turning to FIG. 7, we can examine another embodiment of the four lobe bladder.

Figure 7:
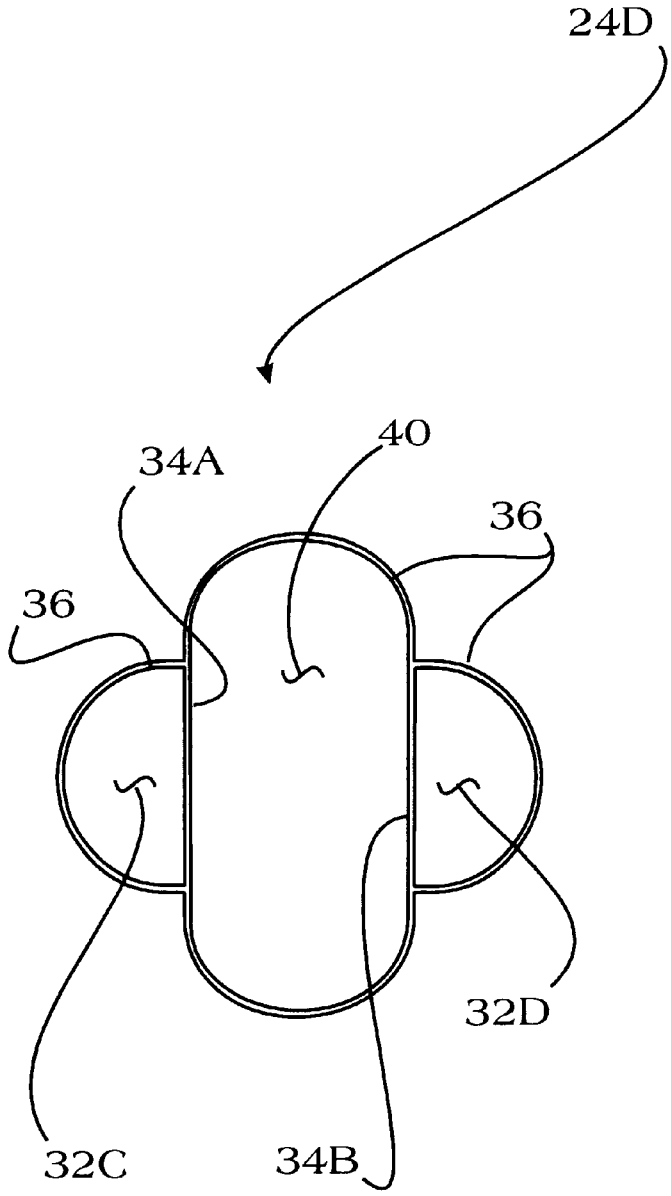
FIG. 7 is a cutaway top view of a three chamber bladder embodiment of the present invention.

FIG. 7 is a cutaway top view of a three chamber bladder embodiment 24D of the present invention. As shown here, the first and second side chambers 32C and 32D, respectively, are confined to the length of the fourth and second lobes (see FIG. 5). A third, center chamber 40 has been created though the existence of the two chamber walls 34A and 34B. As with the previous embodiment, the three chambers 32C, 32D, and 40 are individually inflatable to provide not only side-to-side compensation for sage, but also increased center compensation for the overall center region (see FIG. 5). If we now turn to FIG. 8, we can discuss the most adjustable version of the bladder of the present invention.

Figure 8:
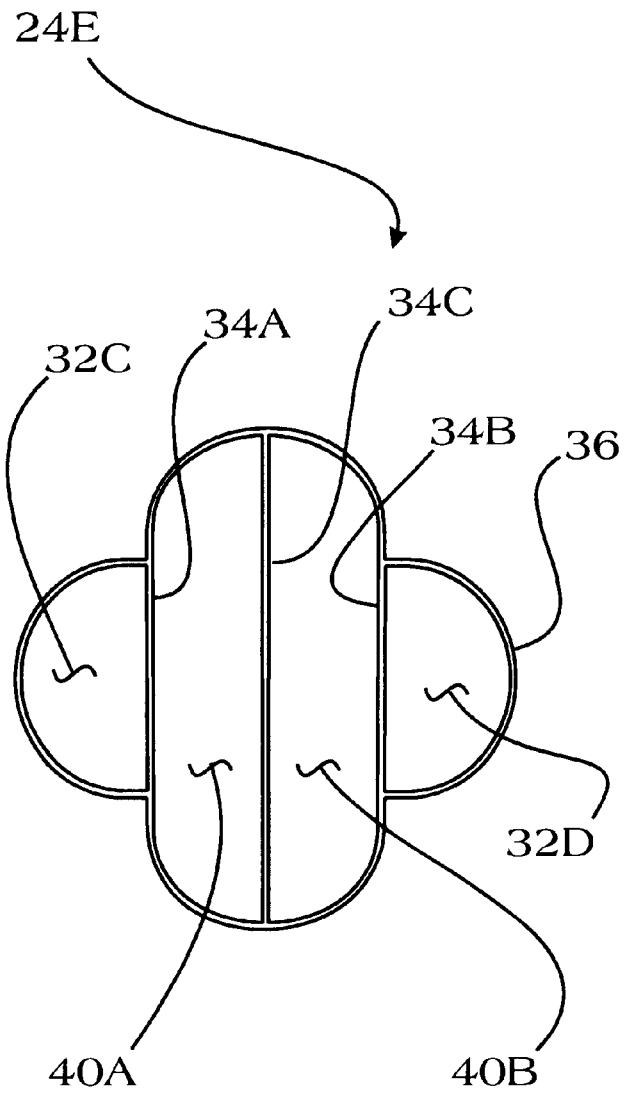
FIG. 8 is a cutaway top view of a four chamber bladder embodiment of the present invention.

FIG. 8 is a cutaway top view of a four chamber bladder embodiment 24E of the present invention. This version 24E essentially combines the two-chamber and three-chamber designs previously discussed. Here, the center chamber is bisected by the chamber wall 34C to form two center chamber halves 40A and 40B, respectively. Furthermore, the first and second side chambers 32C and 32D are created by the chamber walls 34A and 34B. This embodiment 24E, then, provides maximum side-to-side sag compensation, while also providing substantial sag compensation and correction for the very center of the mattress.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A method for correcting a sagging region of a mattress, comprising the steps of:

inserting an inflatable bladder underneath said sagging region, said bladder comprising:

upper and lower sheets of air-tight material arranged in juxtaposed relationship, and attached to one another to form a horizontal periphery, said periphery defining at least two lobes, said bladder formed from air-tight material, said sheets further defining at least one internal chamber extending completely between said upper and lower sheets; and inflating said bladder until said sagging region is flat, said inflating conducted by inflation means for inflating said bladder.

2. The method of claim 1, wherein:

said inserting step comprises inserting an inflatable bladder underneath said sagging region, said bladder comprising four lobes in equally spaced angular relation to one another.

3. The method of claim 1, wherein said bladder of said inserting step comprises:

said lobes comprise a first lobe;

a second lobe extending at a ninety degree angle from said first lobe;

a third lobe extending at a ninety degree angle from said second lobe; and a fourth lobe extending at a ninety degree angle from said third lobe and said first lobe; and said chamber wall bisects said first and third lobes.

4. The method of claim 3, wherein said bladder of said inserting step further comprises a center chamber wall bisecting said second and fourth lobes to form two sub-chambers, and wherein said inflation means in said inflating step comprises means for independently inflating each said sub-chamber.

5. The method of claim 1, wherein said bladder of said inserting step comprises said periphery defining four convex lobes, each said lobe adjacent to a concave portion, said lobes arranged to extend generally horizontally from one another.

6. The method of claim 5, wherein said bladder of said inserting step comprises a center portion and at least one chamber wall bisecting a said lobe from said center portion said chamber wall comprising a sheet of thin material interconnecting said upper and lower sheets.

7. An improved bed apparatus, said bed comprising a mattress atop a box spring, wherein the improvement comprises:

inserting an inflatable device between said mattress and said box spring, said inflatable device comprising:

a bladder comprising at least two lobes, said bladder formed from upper and lower sheets of air-tight material, said sheets arranged in juxtaposed relationship, each said sheet defined by a peripheral edge, said edges of each sheet bonded to one another to form an air-tight seal and defining an internal chamber, said peripheral edges defining four convex lobes, each said lobe adjacent to a concave portion; and inflation means for inflating said bladder.

8. The improvement of claim 7, wherein said bladder comprises a first lobe, a second lobe extending at a ninety degree angle from said first lobe; a third lobe extending at a ninety degree angle from said second lobe and a fourth lobe extending at a ninety degree angle from said third and first lobes.

9. The improvement of claim 8, wherein said bladder further comprises a center portion, and further comprises at least one chamber wall bisecting a said lobe from said center portion, said chamber wall comprising a sheet of thin material interconnecting said upper and lower sheets.

10. The improvement of claim 9, wherein said bladder comprises two said chamber walls bisecting two said lobes from said center portion.

11. The improvement of claim 10, wherein said bladder comprises three said chamber walls bisecting three said lobes from said center portion.

12. The improvement of claim 11, wherein said bladder comprises four said chamber walls bisecting four said lobes from said center portion.

13. The improvement of claim 7, wherein said bladder further comprises a center portion, and further comprises a generally circular chamber wall bisecting said lobes from said center portion.

14. An improved bed apparatus, said bed comprising a mattress atop a box spring, wherein the improvement comprises:

inserting an inflatable device between said mattress and said box spring, said inflatable device comprising:

a bladder consisting essentially of upper and lower sheets of air-tight material, said sheets arranged in juxtaposed relationship, each said sheet defined by a peripheral edge, said edges of each sheet bonded to one another to form an air-tight seal and defining an internal chamber, said peripheral edges defining four generally convex lobes separated from one another by four generally concave portions; and inflation means for inflating said bladder.

15. The improvement of claim 14, wherein said bladder consists essentially of a first lobe, a second lobe extending at a ninety degree angle from said first lobe; a third lobe extending at a ninety degree angle from said second lobe and a fourth lobe extending at a ninety degree angle from said third and first lobes.

16. The improvement of claim 15, wherein said bladder further comprises a center portion, and further comprises at least one chamber wall bisecting a said lobe from said center portion, said chamber wall comprising a sheet of thin material interconnecting said upper and lower sheets.

* * * * *